United States Patent [19]

Osborg

[11] Patent Number: 4,695,292

[45] Date of Patent: Sep. 22, 1987

[54] MOTOR FUEL COMPOSITIONS AND METHODS

[76] Inventor: Hans Osborg, P.O. Box 152, 80 Long View Rd., Port Washington, N.Y. 11050

[21] Appl. No.: 522,548

[22] Filed: Aug. 11, 1983

Related U.S. Application Data

[63] Continuation-in-part of Ser. No. 503,396, Jun. 10, 1983, abandoned.

[51] Int. Cl.[4] ..... C10L 1/22

[52] U.S. Cl. ..... 44/64; 44/56

[58] Field of Search ..... 44/64, 56

[56] References Cited

U.S. PATENT DOCUMENTS

| | | | |
|---|---|---|---|
| 1,906,044 | 4/1933 | Burk | 44/64 |
| 1,958,744 | 5/1934 | Cross | 44/64 |
| 2,062,675 | 12/1936 | Rather et al. | 44/64 |
| 2,729,690 | 1/1956 | Bradley | 44/64 |
| 2,975,136 | 3/1961 | Thomas et al. | 44/64 |
| 4,081,252 | 3/1978 | Osborg | 44/64 |
| 4,197,081 | 4/1980 | Osborg | 44/64 |

OTHER PUBLICATIONS

"The Condensed Chemical Dictionary", p. 451, Feb. 19, 1974.

Morrison & Boyd, Organic Chemistry, pp. 33 & 34, 1959.

*Primary Examiner*—William R. Dixon, Jr.

*Assistant Examiner*—Margaret B. Medley

*Attorney, Agent, or Firm*—Dann, Dorfman, Herrell & Skillman

[57] ABSTRACT

Performance characteristics of motor fuels are improved by the addition of aromatic hydrazine derivatives.

11 Claims, No Drawings

MOTOR FUEL COMPOSITIONS AND METHODS

This application is a continuation-in-part of U.S. patent application Ser. No. 503,396 filed June 10, 1983 now abandoned.

BACKGROUND OF THE INVENTION

1. Field of the Invention

The present invention relates generally to motor fuel containing certain hydrazine derivatives which improve the performance characteristics of the fuel. More specifically, the invention is directed to improved gasoline and gasoline-alcohol (gasohol) blends which contain an aromatic hydrazine additive, and exhibit increased octane number, enhanced misibility, low temperature stability, and reduced corrosiveness toward engine parts, as compared to the same fuel blend without such additive. This invention also pertains to methods for imparting such desirable performance characteristics to motor fuels.

2. Description of the Prior Art

The term "gasohol" is generally applied to a motor fuel comprising a blend of gasoline or other liquid hydrocarbons with various lower alcohols, particularly methanol or ethanol. Typically, such fuel mixtures contain, by volume, approximately 90 to 95% gasoline and 5 to 10% alcohol.

One of the notable advantages of blending gasoline with a lower alcohol is an increase in octane number, permitting less costly petroleum stocks to be used for making gasohol. Octane number is a measure of the degree of knocking of a fuel mixture under standard test conditions. Octane numbers may be reported as motor octane numbers, which are determined under actual road operating conditions or as research octane numbers, which are obtained under test or laboratory conditions. Research octane numbers generally run about 10 points higher than motor octane numbers. A high octane number is one of the essential requirements of a good motor fuel. A fuel blend comprising, by volume, 90% unleaded gasoline and 10% ethanol, for example, has a motor octane number of about 92, whereas unleaded gasoline alone has a motor octane number of about 89.

The increased octane number obtained by blending gasoline with a lower alcohol is offset by several serious drawbacks. First, the addition of a lower alcohol to gasoline generally increases its vapor pressure and adversely affects its distillation characteristics, which may result in hard starting and vapor lock in hot weather, as well as making engine warm-up difficult in cold weather. Second, in comparision to gasoline, the lower alcohols, as a group, have a relatively low heat content or energy value, so that mixing alcohol with gasoline may reduce fuel economy, i.e. lower mileage per gallon. Third, the stability of gasoline-alcohol blends is significantly influenced by variations in composition and temperature. For example, blends having a methanol content of about 10 volume percent or more are susceptible to phase separation, particularly at temperatures below 0° C. The stability problem is exacerbated by the presence of water in the blend. Even as little as a fraction of one-percent of water in certain gasoline-alcohol blends may cause "splitting" of the blend, i.e. separation into an aqueous alcohol phase and a gasoline-hydrocarbon phase. Such separation may cause starting problems, rough engine operation, and fuel-line plugging. Accordingly, anhydrous alcohol must be used for blending with gasoline and extreme care must be exercised so that that the alcohol remains substantially anhydrous during transporation and storage. Fourth, the lower alcohols readily pick up water, and become oxidized in the presence of water, forming aldehydes and acids which tend to corrode metals and cause degradation of plastics, and thus may severly damage engine parts, fuel tanks and fittings, particularly those made of aluminum.

Among the gasoline-alcohol blends that have been tried as motor fuels, the foregoing problems have been most evident with gasoline-methanol blends. Ethanol, although a more desirable fuel component than methanol from a performance standpoint, costs considerably more to produce. Indeed, most previous attempts at large scale marketing of gasoline-ethanol blends have required some sort of tax incentive or subsidy.

If crude oil prices continue to increase and more efficient processes for the manufacture of ethanol become available, gasohol will undoubtedly become price competitive with gasoline. However, even at a competitive price, it is unlikely that gasohol will account for a significant proportion of motor fuel consumption, unless the aforementioned performance problems can be overcome, and the miscibility of alcohol in gasoline can be increased.

In my U.S. Pat. No. 4,081,252, there is described a method for improving the combustion of various fuels, such as ammonia, petroleum distillates, alcohols, amines, or mixtures of such fuels, by adding to the fuel any of a number of hydrogen-carrier compounds for releasing energy and hydrogen at the time of ignition. Among the hydrogen-carrier compounds disclosed as being preferred for admixing with petroleum distillates, e.g. gasoline, are hydrazines, especially alkly hydrazines, such as unsymmetrical dimethyl hydrazine (UDMH). The preference for hydrazines, it is disclosed, is due to the siginficant reduction of undesirable emissions and increased efficiency upon combustion of the resultant fuel mixture. Among the hydrazine additive-containing fuel compositions disclosed in my aforesaid patent, are compositions in which the base fuel is a petroleum distillate or a mixture of gasoline, 20% methanol and 0.5% water. Upon further evaluation of such fuel compositions, however, it has now been discovered that the motor octane number is reduced to an unacceptably low level. These fuel compositions have been determined to have motor octane numbers in the range of about 50 to about 60, which is too low for use as motor fuels.

SUMMARY OF THE INVENTION

In accordance with the present invention, it has now been discovered that motor fuels having improved performance characteristics are obtainable by adding thereto a hydrazine derivative of the formula:

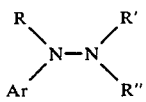

wherein Ar represents a radical selected from the group consisting of aryl having 6 to 15 carbon atoms or aralkyl having 7 to 15 carbon atoms, R, R' and R'' may be the same or different and represent hydrogen or a radical selected from the group consisting of alkyl having 1 to 10 carbon atoms, cycloalkyl having 3 to 8 carbon atoms or Ar, as defined above, and at least one of said R, R', and R'' is hydrogen.

Although these hydrazine derivatives are useful in improving gasoline base stocks, particularly with respect to octane number, they are especially beneficial in improving the overall performance of gasoline-alcohol blends. The addition of such compounds to a gasoline-alcohol blend provides a motor fuel composition having a high octane number and satisfactory heat content, without producing any significant adverse effect on vapor pressure or distillation characteristics. In addition, since the above hydrazine derivatives are Lewis bases, they serve to neutralize the corrosive effect of the alcohol component of the fuel composition, and any water present therein, on engine parts, gasoline tanks, fittings, and the like. Another notable benefit of the above hydrazine derivatives is that they improve the miscibility of the lower alcohols in gasoline over a wide range of temperatures, thereby rendering gasoline-alcohol blends containing such derivatives substantially homogeneous at ambient temperatures. The term "ambient temperatures", as used herein, refers to temperatures within the range of about −20° C. to about 95° C.

Most surprisingly, it has been found that the aforementioned desirable performance characteristics are exhibited in gasoline-methanol blends containing as much as 30 to 40% by volume of methanol.

In one of its method aspects, the present invention provides gasoline-alcohol fuel blends of increased octane number by adding thereto a hydrazine derivative of the above general forumla.

In another of its method aspects, this invention provides gasoline-alcohol fuel blends of enhanced miscibility and stability by adding thereto a hydrazine derivative of the above general formula.

In yet another of its method aspects, this invention provides gasoline-alcohol fuel blends having reduced corrosive effect on engine parts, and the like, by adding thereto a Lewis base, including a hydrazine derivative of the above general formula.

It has been found that the foregoing improvements in performance characteristics are optimized by adding to the base fuel a hydrazine derivative of the above formula in which at least one of R, R', and R'' is an aromatic substituent (Ar), as defined herein. Representative of such derivatives are diphenylhydrazine and dinaphthylhydrazine. A preferred motor fuel composition in accordance with this invention comprises by volume, approximately 59% gasoline, 30% methanol, 10% ethanol and 1% of diphenylhydrazine. It is estimated that for each 100 million barrels of this fuel produced, a savings of 250 million barrels of imported crude oil would result. Were such fuel to account for only a few per cent share of annual motor fuel consumption (which is presently estimated at about 3.5 billion barrels per year) the benefit would be considerable, in terms of furthering energy self-sufficiency and conserving existing oil reserves. A more substantial utilization could possibly reduce requirements for gasoline base stocks to that which could be satisified by domestic sources. Moreover, the large scale requirement for anhydrous methanol and ethanol would have a tendency to expand the markets for these chemicals. Increased demand for ethanol would likewise have the effect of stabilizing the markets for agricultural products from which it is produced. In addition, the penalties in subsidies and lost taxes which have resulted from earlier attempts at ethanol blending could be avoided, making additional revenues available for other useful purposes. Another beneficial consequence of the present invention may be the establishment of a new market for the above-described hydrazine derivatives equal in importance to the market previously established for lead based anti-knock additives.

From the foregoing summary, it will be appreciated that in addition to the enhanced performance characteristics noted above, the improved motor fuel compositions of the present invention have significant economic advantages as well.

DETAILED DESCRIPTION OF THE INVENTION

On essential component of the improved motor fuel composition of the present invention is gasoline. As used herein, the term "gasoline" refers to a mixture of volatile hydrocarbons, including branched-chain paraffins, cycloparaffins and aromatics, which is suitable for operation in a spark-ignited internal combustion engine, and having motor octane number of at least about 60. Suitable gasolines which may be used in the practice of this invention include aviation gasoline, cracked gasoline, natural gasoline, polymer gasoline, pyrolysis gasoline, reformed gasoline, straight-run gasoline white gasoline and isomerized gasoline. Regular, unleaded gasoline is preferred because of its general availability.

Another essential component of the improved motor fuel compositions of the present invention is a hydrazine derivative of the general formula:

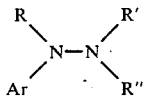

wherein Ar represents a radical selected from the group consisting of aryl having 6 to 15 carbon atoms or aralkyl having 7 to 15 carbon atoms, R, R' and R'' may be the same or different and represent hydrogen or a radical selected from the group consisting of alkyl having 1 to 10 carbon atoms, cycloalkyl having 3 to 8 carbon atoms or Ar, as herein defined, and at least one of said R, R', and R'' is hydrogen.

These hydrazine derivatives may be prepared according to a process developed by me which is the subject of a co-pending U.S. patent application. Basically, the process involves initially reacting an alkali metal amide, alkaline earth metal amide or an primary or with a halogenating agent, such as chlorine gas, to produce chloramine. The chloramine thus produced undergoes reaction with a tertiary-amine to produce a tertiary-hydrazinium halide. The tertiary-hydrazinium halide is thereafter reacted with an an alkali metal derivative of an appropriate aromatic amine, such as the sodium derivative of aniline under substantially anhydrous conditions to produce the desired hydrazine derivative.

Chloramine production is desirably carried out in an inert, non-aqueous reaction medium, preferably one that is miscible with the desired chloramine and the tertiary-amine with which the chloramine is to be reacted in the following process step. The reaction medium should be immiscible with water, to facilitate product separation. The reaction is conveniently carried out at room temperature and atmospheric pressure.

The order of addition of the reactants to the reaction medium is not critical.

The tertiary hydrazinium halide is prepared by introducing the chloramine into a slight excess of a tertiary amine, such as trimethyl-, triethyl-, tripropyl- or tributyl amine, maintained at a temperature of about 0° to about 25° C. As the reactants are mixed together, crystallization of the product begins to occur and the reaction is complete in about 10 minutes or less.

The aromatic-substituted hydrazines are obtained by the reaction of the tertiary-hydrazinium halide with an an alkali metal derivative of a suitable aromatic amine in the presence of a non-aqueous reaction medium as exemplified in my U.S. Pat. No. 4,286,108, the entire disclosure of which is incorporated herein by reference.

Those skilled in the art will appreciate that the hydrazine derivative selected for admixing with a particular motor fuel must be inert in respect to chemical reaction therewith under ordinary and ambient temperature conditions. By "inert" is meant that the hydrazine derivative selected is stable and non-reactive with the motor fuel under ordinary storage conditions and does not adversely affect the shelf life of the motor fuel.

In addition to gasoline, an essential component of the preferred fuel compositions of this invention is a lower alcohol, for example, methanol, ethanol, propanol, butanol, pentanol, hexanol and isomers thereof. Methanol and ethanol are preferred because of their general availability. Methanol is especially preferred because of its relatively low price. The methanol may contain minor amounts of propanol and butanol, as exemplified hereinbelow. The alcohols may be derived from various sources by processes well known to those skilled in the art. For example, methanol may be prepared by the destructive distillation of wood or from synthesis gas. Ethanol may be produced from ethylene or by fermentation of agricultural products. Depending on the process of production, impurities such as water, higher alcohols and other oxygenated compounds may be present in the alcohol to a greater or lesser extent.

The blending of gasoline and alcohol and the addition of the above hydrazine derivative to the base fuel to obtain the improved motor fuel compositions of the present inventon are accomplished using mixing apparatus and procedures well known to those skilled in the art.

When a hydrazine derivative of the above general formula is admixed with a gasoline-alcohol blend, the resulting fuel composition preferably comprises, by weight, from about 50 to about 95% gasoline, from 4.75 to 49.75% alcohol and from 0.25 to about 5.0% of the hydrazine derivative. The hydrazine should be added in an amount of at least 0.25%, or else the above-noted improvement in performance is not fully realized. The addition of hydrazine derivative in excess of 5.0% is generally no cost effective. The octane number of the improved gasoline-alcohol blends is generally between about 85 and about 95, calculated as the numerical average of the motor octane number and the research octane number.

As indicated above, the preferred hydrazine derivatives for use in the present invention are those in which at least one of R, R′, and R″ in the above general formula is Ar, as defined herein. A particularly preferred gasoline-alcohol blend containing these preferred additives comprises, by weight, about 59% gasoline, about 30% methanol, about 10% ethanol and 1% diphenylhydrazine.

When the hydrazine derivative is mixed with a gasoline base stock, the resultant fuel composition preferably comprises, by weight, about 95 to 99.75% gasoline and about 0.25 to 5.0% of the hydrazine derivative. These quantitative limits are based generally on the same considerations mentioned above with respect to the improved gasoline-alcohol blends. The octane number of the resultant fuel composition is generally between about 85 and 95 calculated as the numerical average of the motor octane number and the research octane number. Most preferably, a diphenylhydrazine is added to the gasoline base stock in an amount constituting, by weight, from about 0.5% to about 2% of the total composition.

Although the basic nature of the hydrazine derivative provides a measure of corrsion inhibition when added to a gasoline-alcohol blend, as mentioned above, it is beneficial to incorporate in the fuel composition an additional compatible Lewis base in an amount sufficient to provide the composition with a pH of greater than 7, and thereby further enhance the inhibition of corrosive attack on engine components by the fuel composition. Suitable Lewis bases for this purpose are ammonia, organic amines, such as mono-, di- and trialkylamines or a mixture thereof.

In addition, the fuel compositions of this invention may contain other additives having specific desired functions. For example, combustion deposite modifiers, such as clays, may be added to the compositions of the agents, detergents, dyes, lubricants and like conventional fuel additives may be added to the fuel composition of the invention in conventional proportions to effect their particular purpose upon combustion of the fuel compositions of the invention.

The compositions of the invention may be combusted in a conventional internal combustion engine or an engine modified to meet the special properties of an individual composition to obtain maximum efficiency, i.e. an engine equipped with means for regulating compression ratios, cycle timing, air fuel mixtures, fuel flow and the like to meet the specific combustion characteristics of the fuels provided in accordance with this invention. Those skilled in art will appreciate how to effect the desired and advantageous modifications when required for maximum fuel efficiency.

The following examples further describe the manner and process of making and using the present invention and set forth the best mode contemplated for carrying out the invention, but are not to be construed as limiting the invention. All percentages, parts or proportions are by weight and all temperatures are in ° C. unless otherwise indicated.

EXAMPLE 1

A gas washing bottle provided with a gas dispersion tube at the bottom was charged with 100 ml. of kerosene, 0.1 mole of sodamide (4.0 grams) and 0.1 mole of tripropylamine (14.4 grams). A 0.1 mole quantity of chlorine gas (7.1 grams) diluted with nitrogen gas was introduced into the reaction mixture through the dispersion tube. The reaction was carried out at 0° C. for 30–40 minutes. Thereafter, the temperature of the reaction mixture was allowed to come to room temperature and the pressure in the reaction vessel was reduced to remove any volatile material. The yield of tripropylhydrazinium chloride which contained some sodium chloride, as well, was approximately 75%.

The tripropylhydrazinum chloride product may be reacted with the sodium derivative of aniline according to the procedure described in Example 11 of my aforesaid U.S. Patent No. 4,286,108 to produce phenyhydrazine, the yield of the overall reaction scheme being approximately 60%.

The compound 1,1-diphenylhydrazine (m.p. 34.5°) may be similarly prepared by substituting N-phenylaniline (diphenylamine) for aniline in the foregoing example.

The compound 1,2-diphenylhydrazine (m.p. 126°) may be conveniently prepared according to the procedure of Olah reported in 81 J.A.C.S. 3165 (1962).

As between the 1,1-and 1,2-diphenylhydrazines, the former is preferred for use in accordance with the present invention, because its melting point is relatively closer to room temperature, permitting it to be readily converted to liquid form and mixed with the base fuel using conventional liquid blending apparatus.

Other diaromatic-substituted hydrazines, e.g. dinaphtylhydrazines may be prepared by the same general procedures described above for the preparation of 1,1-and 1-2 diphenylhydrazine.

The sample fuel composition used in the tests described hereinbelow were prepared by making up the base fuel composition in the relative quantities indicated in the tables, and adding thereto the specified hydrazine derivative in a quantity equivalent to the weight percentage set forth in the tables. In each test duplicate samples were run and the values listed in the tables represent the average of the two runs.

Octane numbers were determined for several preferred fuel compositions of the present invention. The octane number of a similar fuel composition containing UDMH, rather than an aromatic-substituted hydrazine, was also determined as a basis of comparison. The results are set forth in Table I below.

TABLE I

| Sample No. | Base Fuel (Relative Vols.) | Hydrazine Additives (Wt. %) | Octane No. Research | Octane No. Motor |
|---|---|---|---|---|
| 1 | Gasohol[a] + Methanol[b] (70:30) | 1,1 DPH[d] (2) | 95.1 | 81.1 |
| 2 | Gasoline[c] + Methanol (60:40) | DPH[d] (1) | 97.3 | 83.7 |
| 3 | Gasohol + Methanol (70:30) | DPH[d] (1) | 98.0 | 83.8 |
| 4 | Gasoline + Methanol (60:40) | DPH[d] (2) | 95.4 | 81.4 |
| 5 | Gasoline + Methanol (63:37) | PH[e] (7) | 72.8 | 66.0 |
| 6 | Gasoline + Methanol (63:37) | UDHM (5) | 67.7 | 58.2 |

[a]By volume, 90% unleaded, regular gasoline and 10% ethanol (200 proof).
[b]By volume, 90% reagent grade methanol, 2.5% n-propanol and 2.5% n-butanol; same stock mixture of methanol used in all base fuels in Table I.
[c]Unleaded, regular gasoline; gasoline from same source used in all base fuels in Table I.
[d]DPH = diphenylhydrazine.
[e]PH = phenylhydrazine.

The octane numbers reported in Table I were determined by E. W. Saybolt & Co., Inc. using standard test procedures. Several attempts were made to determine the octane number of the gasoline-alcohol blends without the hydrazine derivative, but were unsuccessful due to phase separation of the components.

The data in Table I show that the fuel compositions of the present invention meet the octane member requirement for an acceptable motor fuel. The octane numbers achieved by the addition of a diaromaticsubstituted hydrazine far exceed those of prior art gasoline-alcohol blends modified with UDMH.

The effect produced by hydrazine derivatives of the type described above on the miscibility of gas and alcohol was evaluated by mixing certain hydrazine derivatives with gasoline-alcohol blends over a wide temperature range and visually determining whether a true solution was obtained. In conducting this evaluation, a measured quantity of each component of the gasoline-alcohol blend was placed in a vessel at room temperature. The amounts selected resulted in an immiscible mixture. Measured quantities of the hydrazine derivatives were delivered slowly to the gas-alcohol blend with stirring. Addition of the hydrazine derivative continued until the mixture was observed to form a true solution. Once a true solution was obtained, the mixture was cooled to −22° in a bath of dry ice (CO2) and carbon tetrachloride. If the mixture became immiscible upon cooling, the addition of the hydrazine derivative was resumed until a true solution was once again obtained. Here again, as a basis of comparison, a similar evaluation was made of the effect of UDMH on the miscibility of gasoline and alcohol in the same blends used to evaulate the aromatic-substituted hydrazine additives. The results of the miscibility evaluation are set forth Table II below.

TABLE II

| Sample No. | Base Fuel (Relative Vols.) | Hydrazine Additive | Hydrazine Required for True Solution at RT. | Hydrazine Required for True Solution at −22° |
|---|---|---|---|---|
| 7 | Gasoline[c] + Methanol[b] (70:30) | UDMH | 1.90 | 4.94 |
| 8 | Gasoline[c] + Methanol[b] (70:30) | PH[e] | 2.86 | 7.80 |
| 9 | Gasoline[c] + Methanol[b] (70:30) | 1,2-DPH[d] | 0.96 | 0.99 |
| 10 | Gasoline + Methanol (60:40) | UDMH | 2.20 | 5.70 |
| 11 | Gasoline + Methanol (60:40) | PH | 3.02 | 8.00 |
| 12 | Gasoline + Methanol (60:40) | 1,1-DPH | 1.36 | 1.42 |
| 13 | Gasoline + Methanol (60:40) | 1,2-DPH | 1.38 | 1.50 |
| 14 | Gasoline + Ethanol (60:40) | UHMH | 2.11 | 5.86 |
| 15 | Gasoline + Ethanol (60:40) | PH | 3.00 | 8.05 |
| 16 | Gasoline + Ethanol (60:40) | 1,2-DPH | 1.24 | 1.56 |
| 17 | Indolene[f] + Methanol (70:30) | UDMH | 1.26 | 4.52 |
| 18 | Indolene[f] + Methanol (70:30) | PH | 1.44 | 6.16 |
| 19 | Indolene[f] + Methanol (70:30) | 1,2-DPH | 0.82 | 4.84 |
| 20 | Indolene + Methanol (60:40) | UDMH | 2.56 | 6.23 |
| 21 | Indolene + Methanol (60:40) | PH | 2.29 | 6.94 |
| 22 | Indolene + Methanol (60:40) | 1,2-DPH | 0.82 | 4.84 |
| 23 | Indolene + Ethanol (60:40) | UDMH | 2.68 | 6.22 |
| 24 | Indolene + Ethanol (60:40) | PH | 2.39 | 7.34 |
| 25 | Indolene + Ethanol (60:40) | 1,2-DPH | 1.37 | 5.50 |
| 26 | Gasohol[a] + Methanol (70:30) | 1,1-DPH | 0.89 | 1.00 |
| 27 | Gasohol[a] + Methanol (70:30) | 1,2-DPH | 1.36 | 1.52 |
| 28 | Gasohol + Methanol (80:20) | 1,1-DPH | 0.51 | 0.77 |
| 29 | Gasohol + | 1,2-DPH | 0.42 | 1.46 |

TABLE II-continued

| Sample No. | Base Fuel (Relative Vols.) | Hydrazine Additive | Hydrazine Required for True Solution at RT. | Hydrazine Required for True Solution at −22° |
|---|---|---|---|---|
| | Methanol (80:20) | | | |
| 30 | Gasohol + Methanol (90:10) | 1,1-DPH | 0.34 | 0.41 |
| 31 | Gasohol + Methanol (90:10) | 1,2-DPH | 0.29 | 0.96 |

[a]See Table I, above
[b]See Table I, above
[c]See Table I, above
[d]See Table I, above
[e]See Table I, above
[f]Indolene Motor Fuel; a product of AMOCO Oil, Co. containing (approx.) 30% aromatics, 15% olefins, 55% paraffins/napthenes, a small amount of antioxidant and no octane additives, and having an octane no. (Research + Motor/2) of 87.

The data in Table II show that blends of gasoline with substantial quantities of lower alcohols are readily obtained as true solutions by the addition thereto of a relatively small amount of phenylhydrazine or diphenylhydrazine. More importantly, the resulting solutions are stable at temperatures as low as −20°. The data also show that the quantity of 1,1-diphenylhydrazine required to achieve low temperature stability is less than that of the 1,2-diphenylhdyrazine.

The heats of combustion were measured for several motor fuel compositions of the present invention, which contain 1,1- and 1,2-diphenylhydrazine as the hydrazine derivative, and are set forth in Table III below. The heats of combustion were measured using a Parr adiabatic calorimeter with a voltile liquid sample cell specifically designed for fuel samples. The calorimeter was standarized with isooctane after each 4 measurements in order minimize any inconsistencies due to variations in the calorimeter system during the course of the measurements.

The specific fuel compositions tested were the same as samples numbers 11, 12 and 26 through 31 of Table II, above. The heats of combustions of unleaded, regular gasoline and a gasoline-methanol blend without any added hydrazine derivative are included in Table III for the purpose of comparison.

TABLE III

| Sample No. | Base Fuel (Relative Vols.) | Hydrazine Additive | Heat of Combustion (cal/gm.) |
|---|---|---|---|
| 11 | Gasoline[c] + Methanol[b] (60:40) | 1,1-DPH[d] | 8840 |
| 12 | Gasoline[c] + Methanol[b] (60:40) | 1,2-DPH | 8890 |
| 26 | Gasohol[a] + Methanol (70:30) | 1,1-DPH | 8880 |
| 27 | Gasohol[a] + Methanol (70:30) | 1,2-DPH | 8928 |
| 28 | Gasohol + Methanol (80:20) | 1,1-DPH | 8930 |
| 29 | Gasohol + Methanol (80:20) | 1,2-DPH | 9010 |
| 30 | Gasohol + Methanol (90:10) | 1,1-DPH | 9005 |
| 31 | Gasohol + Methanol (90:10) | 1,2-DPH | 9098 |
| | Gasoline | — | 9216 |
| | Gasoline Methanol[g] (60:40) | — | 8604 |

[a]See Table I, above
[b]See Table I, above
[c]See Table I, above
[d]See Table I, above
[g]100% reagent grade methanol.

The data in Table III show that gasoline-alcohol blends containing 1,1- and 1,2-diphenylhydrazine have heats of combustion comparable to regular unleaded gasoline, while similar fuels containing no such additive have heats of combustion considerably below that of regular unleaded gasoline.

Based on the test results tabulated above, those skilled in the art will appreciate that the motor fuel compositions of the present invention are characterized by relatively high octane number, excellent stability over a wide temperature range, and satisfactory heat of combustion. Such desirable performance characteristics are obtained notwithstanding the presence of substantial quantities of methanol in the fuel compositions.

It is anticipated that the addition of 1,1- and 1,2-dinapthalhydrazine to the base fuels described above would produce improved performance results similar to those reported herein for the diphenylhydrazine additives.

While the invention has been described in terms of certain presently preferred embodiments, many other embodiments may be readily apparent to those skilled in the art. The invention is therefore, not limited to the embodiments described, but is capable of variation and modification without departing from the spirit and scope of the appended claims.

What is claimed is:

1. A liquid fuel mixture comprising gasoline, at least one alcohol selected from the group consisting of methanol, ethanol, propanol, butanol, pentanol, hexanol, and isomers thereof, and a hydrazine derivative of the formula:

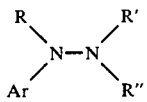

wherein Ar represents a radical selected from the group consisting of aryl having 6 to 15 carbon atoms or aralkyl having 7 to 15 carbon atoms, R, R' and R'' may be the same or different and represent hydrogen or a racical selected from the group consisting of alkyl having 1 to 10 carbon atoms, cycloalkyl having 3 to 8 carbon atoms or Ar, as herein defined, and at least one of said R, R', and R'' is hydrogen, said mixture being homogeneous at ambient temperatures, and the composition of said mixture comprising, by weight, from about 50% to about 95% gasoline, from about 4.75% about 49.75% alcohol and from about 0.25% to about 5.0% hydrazine derivative.

2. The mixture of claim 1, wherein said alcohol is methanol or ethanol or a mixture thereof.

3. The mixture of claim 1, wherein said alcohol is methanol containing minor amounts of propanol and butanol.

4. The mixture of claim 1, wherein Ar is naphthyl.

5. The mixture of claim 1, wherein Ar is phenyl.

6. The mixture of claim 1, wherein at least one of R, R' and R'' is Ar.

7. The mixture of claim 6, wherein said hydrazine derivative is a dinaphthylhydrazine.

8. The mixture of claim 6, wherein said hydrazine derivative is a diphenylhydrazine.

9. The mixture of claim 8, wherein said alcohol is selected from methanol, ethanol or a mixture thereof.

10. The mixture of claim 8, wherein said alcohol is methanol containing minor amounts of propanol and butanol.

11. The mixture of claim 1, which further includes a compatible Lewis base, selected from ammonia, a mono-, di- or trialkylamine, or a mixture thereof.

* * * * *

UNITED STATES PATENT AND TRADEMARK OFFICE

CERTIFICATE OF CORRECTION

PATENT NO. : 4,695,292

DATED : September 22, 1987

INVENTOR(S) : Osborg

It is certified that error appears in the above-identified patent and that said Letters Patent is hereby corrected as shown below:

Col. 1, line 31, change "petroleum stocks" to --petroleum base stocks--;

Col. 4, line 51, delete "alkaline earth metal amide or an primary or";

Col. 5, line 44, change "inventon" to --invention--;

Col. 5, line 56, change "no" to --not--;

Col. 6, line 29, change "deposite" to --deposit--;

Col. 6, line 30, after "of the" insert --invention. Anti-oxidants, metal deactivators, anti-icing--;

Col. 7, line 21, change "tylhydrazines" to --thylhydrazines--;

Col. 7, Table I, under the heading "Hydrazine Additives" in Sample 2, 3, and 4, before "DPH" insert --1,1--;

Col. 10, line 37, change "racical" to --radical--.

Signed and Sealed this

Twenty-fifth Day of October, 1988

*Attest:*

*Attesting Officer*

DONALD J. QUIGG

*Commissioner of Patents and Trademarks*